US006923128B2

(12) United States Patent
Seeber

(10) Patent No.: US 6,923,128 B2
(45) Date of Patent: Aug. 2, 2005

(54) CIRCULATING FLUIDIZED BED REACTOR

(75) Inventor: Joachim Seeber, Wernau (DE)

(73) Assignee: ALSTOM Power Boiler GmbH, Stuttgart (DE)

( * ) Notice: Subject to any disclaimer, the term of this patent is extended or adjusted under 35 U.S.C. 154(b) by 0 days.

(21) Appl. No.: 10/748,413

(22) Filed: Dec. 30, 2003

(65) Prior Publication Data

US 2004/0182293 A1 Sep. 23, 2004

(30) Foreign Application Priority Data

Jan. 10, 2003 (DE) ..... 103 00 838

(51) Int. Cl.[7] ..... F23G 5/30; F23C 1/10
(52) U.S. Cl. ..... 110/245; 110/261
(58) Field of Search ..... 110/261, 263, 110/243, 244, 245; 122/4 D; 422/147, 139, 144; 208/161; 55/346

(56) References Cited

U.S. PATENT DOCUMENTS 5,069,170 A * 12/1991 Gorzegno et al. ..... 122/4 D
5,069,171 A * 12/1991 Hansen et al. ..... 122/4 D
5,463,968 A * 11/1995 Abdulally ..... 110/347
5,682,828 A * 11/1997 Phalen et al. ..... 110/245
5,829,368 A * 11/1998 Cote et al. ..... 110/342
6,418,866 B1 * 7/2002 Shimizu et al. ..... 110/347

FOREIGN PATENT DOCUMENTS

DE 38 35 172 A1 4/1990

* cited by examiner

*Primary Examiner*—Kenneth Rinehart
(74) *Attorney, Agent, or Firm*—Alix, Yale & Ristas, LLP

(57) ABSTRACT

A circulating fluidized bed reactor includes a reactor chamber, at least one duct connected with the reactor chamber for drawing off a flue gas having entrained solid particles from the reactor chamber, at least one cyclone separator that is connected with the duct for separating solid particles from the flue gas, at least one recirculation device for recirculating at least a portion of the separated solid particles from the cyclone separator into the reactor chamber. The recirculation device comprises a siphon-trap gas seal including a riser having first and second outlet openings on the circumference proximate to the upper end, the first and second outlet openings pointing substantially in the direction of the reactor chamber. The recirculation device also comprises a device for fluidizing the portion of the separated solid particles and a device for connecting each opening of the gas seal riser with the reactor chamber.

8 Claims, 3 Drawing Sheets

CIRCULATING FLUIDIZED BED REACTOR

BACKGROUND OF THE INVENTION

The invention pertains to a circulating fluidized bed reactor.

Such fluidized bed reactors are used in power engineering and power plant engineering, among other applications. There, coal or other combustible materials, such as trash or biomass, for example, are burned in the fluidized bed of the reactor combustion chamber. In order to separate and recirculate a portion of the solid particles contained in the flue gas back into the reactor chamber, the fluidized bed reactor exhibits a centrifugal separator, generally a cyclone separator. In conjunction with this, the separated solid particles are fluidized prior to their recirculation into the combustion chamber, and are conveyed to the combustion chamber inlet openings in order to be distributed essentially uniformly over the width of the fluidized bed.

Such a fluidized bed reactor has become known from specification EP 0 161 970 B1. The technical teaching of this document provides that separated solids are drawn from the cyclone separator by means of a vertical standpipe. At its lower end, the standpipe leads to the center of a duct that is placed horizontally and parallel to the back wall of the combustion chamber, and from each of the two ends of the horizontal duct, a pipe leads first vertically upward and then inclined diagonally downward into the combustion chamber. In order to distribute the solid material within the horizontal duct and continue the conveyance, a fluidizing device, which exhibits multiple air chambers and through which a fluidizing gas, usually air, is supplied, is provided inside the horizontal duct.

In this known arrangement of the recirculation of solids into the combustion chamber, it proves to be disadvantageous that, due to the protruding horizontal duct underneath the standpipe, there is a large space requirement in the area of this duct and as a result, the design cannot be executed in a compact fashion. This has a negative effect on the placing of the surrounding components such as the coaling conveyers, for example, which have to be placed at a greater distance from the coal discharge into the recirculation pipes. In addition, markedly more fluidizing air is needed for the fluidization of this horizontal duct than is the case in facilities that have only a recirculation pipe and thus no horizontal duct.

SUMMARY OF THE INVENTION

It is thus the task of this invention to create a fluidized bed reactor which exhibits a compact and space-saving solids recirculation pipe, and by means of which the recirculated solids can be supplied or fed, distributed essentially uniformly across the width of the combustion chamber, to the fluidized bed.

Using the solution according to the invention, a circulating fluidized bed reactor is created that exhibits the following advantages: compact design, more favorable arrangement of the coal conveyors in terms of the coal discharge into the recirculation pipe, less need for fluidization air, and more uniform apportionment of the recirculated ash to the two recirculation pipes.

In an advantageous form of the invention, the two outlet openings of the gas-seal riser are placed at the same height and at an angle of 60 to 180° to each other. As a result of the placement at the same height, uniform distribution of the solid particles to the two pipes can be achieved.

In an especially advantageous form of the invention, the two outlet openings of the gas-seal riser are placed at the same height and at an angle of 90° to each other. Along with the uniform distribution of the solid particles, an especially compact form of the invention is achieved.

It is expedient to place the two outlet openings of the gas-seal riser symmetrical to the longitudinal axis of the recirculation device. Along with the compact design, a simple structural solution is thus achieved as well.

An advantageous further development of the invention provides that the devices for connecting the gas-seal riser outlet openings with the reactor chamber inlet openings each essentially exhibit, starting from the outlet openings, a connecting piece that is inclined downward and at an angle of 30 to 90° to the longitudinal axis of the recirculation device, a connecting part that adjoins the connecting piece and runs perpendicularly downward, and adjoining that, a connecting part that is inclined downward. By means of this development, a design is made available that is easy to produce and extremely reliable during operation of the facility.

A further advantageous form of the invention provides for placing the connecting pieces after the riser symmetrical to each other in order thereby to achieve a solution that is simple in design and operation.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
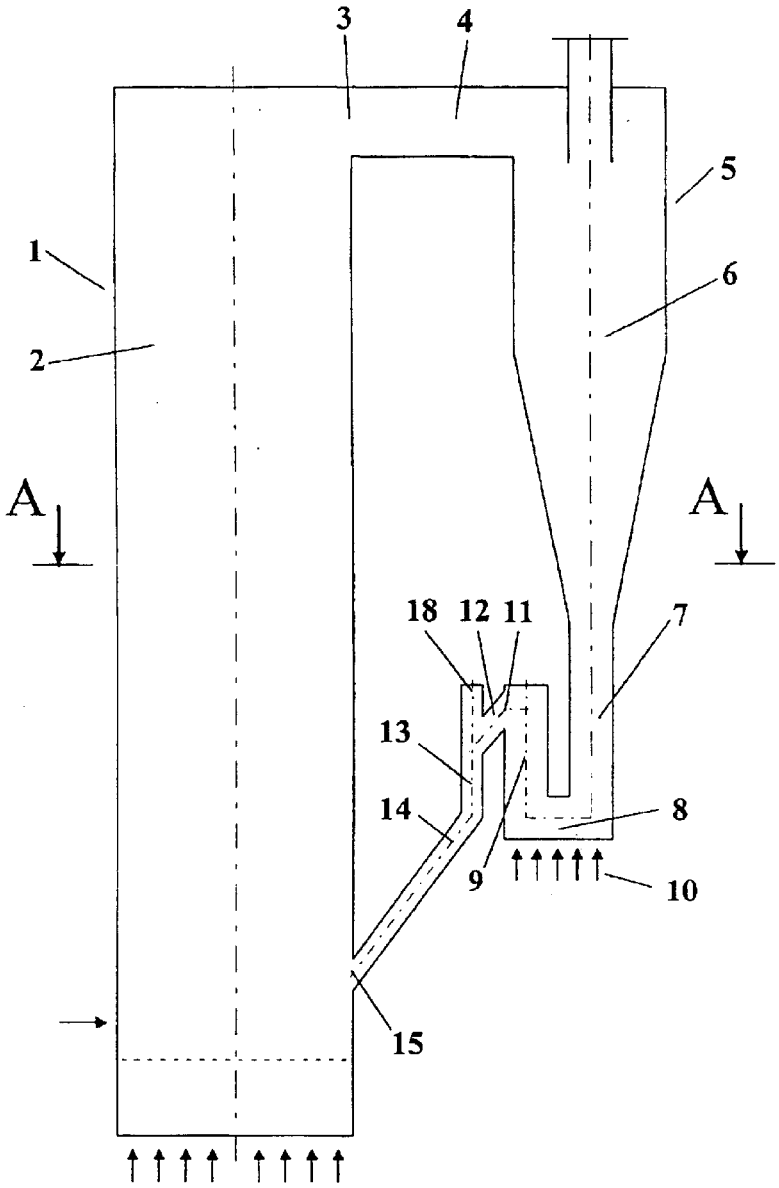
FIG. 1 a schematic representation of a fluidized bed reactor in section across its height, FIG. 2 a schematic representation of a fluidized bed reactor in cross section according to section A—A in FIG. 1, FIG. 3 the front view of a portion of the recirculation pipe according to view B in FIG. 2, FIG. 4 the side view of a portion of the recirculation pipe according to view C in FIG. 2, FIG. 5 the cross section of a portion of the recirculation pipe according to section D—D in FIG. 4.

FIG. 1 shows a schematic representation of a circulating fluidized bed reactor 1 that exhibits a reactor chamber or combustion chamber 2. The fluidized bed reactor 1 can be a gasification reactor, a combustion reactor, a steam generator or another reactor or device known to the person skilled in the art. Primary and secondary gases or air are sent to the reactor chamber 2 through the bottom and the side walls by means of facilities that are not shown. Each of the two cyclone separators 5 is connected by means of an opening 3 with the upper end of the reactor chamber 2. Ducts 4 connect the outlet openings 3 with the cyclone separators 5. The flue gas that is generated in the reactor chamber 2 is directed from the reactor chamber 2 through the outlet openings 3 and through the ducts 4 into the cyclone separators 5. In conjunction with that, the ducts 4 are placed in such a way that they direct the solids-charged flue gas into the cyclone separators 5 tangentially. The cyclone separators 5 separate the hot flue gas from the solid particles, which arrive at the lower, conical region of the cyclone chambers 6 as the result of gravity.

Each of the lower, conical regions of the chambers 6 of the two cyclone separators 5 is connected to a standpipe 7, through which the solids collected in the conical region are drawn off and sent to a siphon-trap-like gas seal 7, 8, 9. In that regard, the gas seal 7, 8, 9 is formed by two essentially vertical pipes, first by the standpipe 7 and second by the riser 9, which are connected to each other by a horizontal duct 8 and which both communicate with each other. In an advantageous form of the invention, the longitudinal axis of the horizontal duct 8, which also corresponds to the recirculation device longitudinal axis 17, is aligned parallel to the longitudinal axis 16 of the reactor chamber 2. If design measures require it, it would also be possible to place the recirculation device longitudinal axis 17 at an angle to the longitudinal axis 16 of the reactor chamber 2. The gas seal 7, 8, 9, in which solids collect up to the height of the lower edge of the outlet openings 11 located at the upper end of the riser 9 and placed at the circumference, prevents an unwanted escape of flue gases from the reactor chamber 2 through the solids recirculation pipe in the direction of the cyclone separators 5. The axial upper end of the riser 9 is made leakproof.

In order that the solid particles to be recirculated that are collecting in the gas seal 7, 8, 9 do not become compacted and deposited, fluidizing gas or air is supplied by means of a fluidizing device 10 essentially from beneath the gas seal or horizontal duct 8. Compacting of the solid particles is prevented in this way, and the transport of the solids in the direction of the reactor chamber 2 is maintained.

According to FIGS. 2 through 5, the riser 9 is designed at its upper end with two outlet openings 11 that are placed at the circumference and advantageously located at the same height. In conjunction with that, the outlet openings 11 are placed essentially in the direction of the reactor chamber 2, and specifically, starting at the recirculation device longitudinal axis 17, advantageously to both sides at 30 to 90°, and especially advantageously at 45°, so that the two outlet openings 11 are placed at an angle to each other of between 60 and 180° or 90°, respectively. From the outlet openings 11 in an extension of the outlet angle, downwardly inclined connecting pieces 12 lead to connecting parts 13 that run vertically downward and that in turn lead to downwardly inclined connecting parts 14. The two connecting parts 14 can be placed parallel to each other and, in an advantageous further development of the invention, parallel to the reactor chamber longitudinal axis 16 or the recirculation device longitudinal axis 17, and are at a distance from each other. The lower end of each of the connecting parts 14 runs into the reactor chamber 2 inlet openings 15, through which the solid particles that are to be recirculated by means of the recirculation pipe are returned to the reactor chamber 2.

Both of the inlet openings 15 are placed at the same height in the lower region of the reactor chamber 2, and the distances of the inlet openings 15 viewed across the width of the reactor chamber 2, and thus the placement of the connecting parts 14 as well, are formed in such a way that an essentially uniform distribution of the solid particles returned to the reactor chamber 2 takes place. Along with the returned ash or solid particles, the fuel that is fed into the connecting parts 13 and 14 of the recirculation pipe by means of a feed pipe 18 after the siphon-trap-like gas seal is also distributed uniformly in the combustion chamber 2.

Through the inventive design of the recirculation pipe and the separation of the recirculation pipe first at the riser 9, a significantly more compact design is achieved because a wide solids distribution station or distribution duct is no longer required, and as a result the fuel transport system (not shown) into the recirculation pipe is simplified substantially. In addition, no complex fluidization device 10 is needed at the horizontal duct 8, and in comparison with the known design according to the state of the art, substantially less fluidization air is needed as well, which results in a reduction of the need for electric power for the fluidization compressor.

Figure 2:
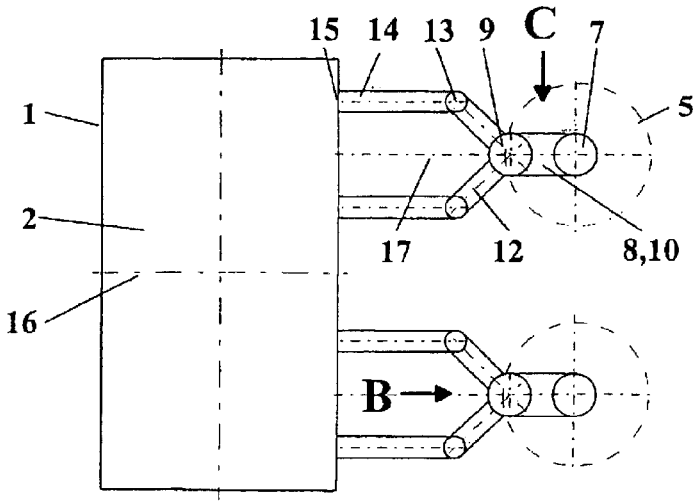
Figure 3:
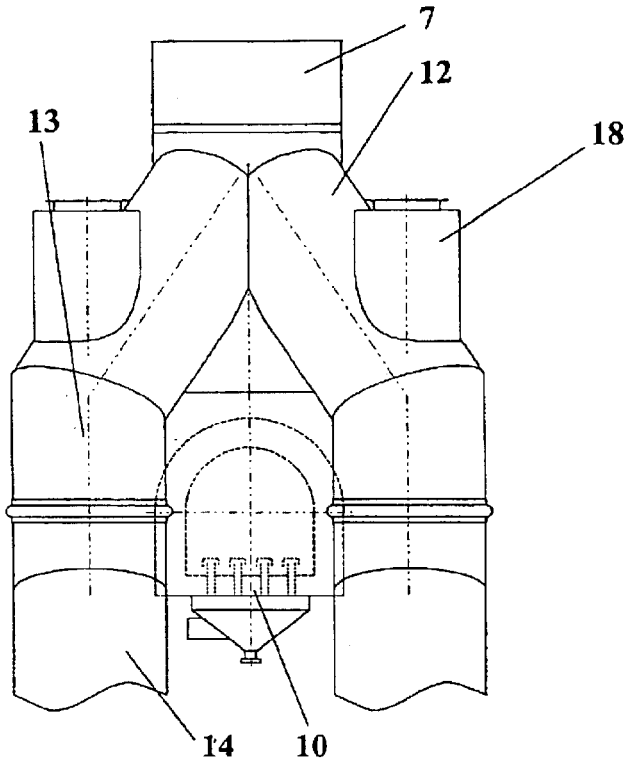
Figure 4:
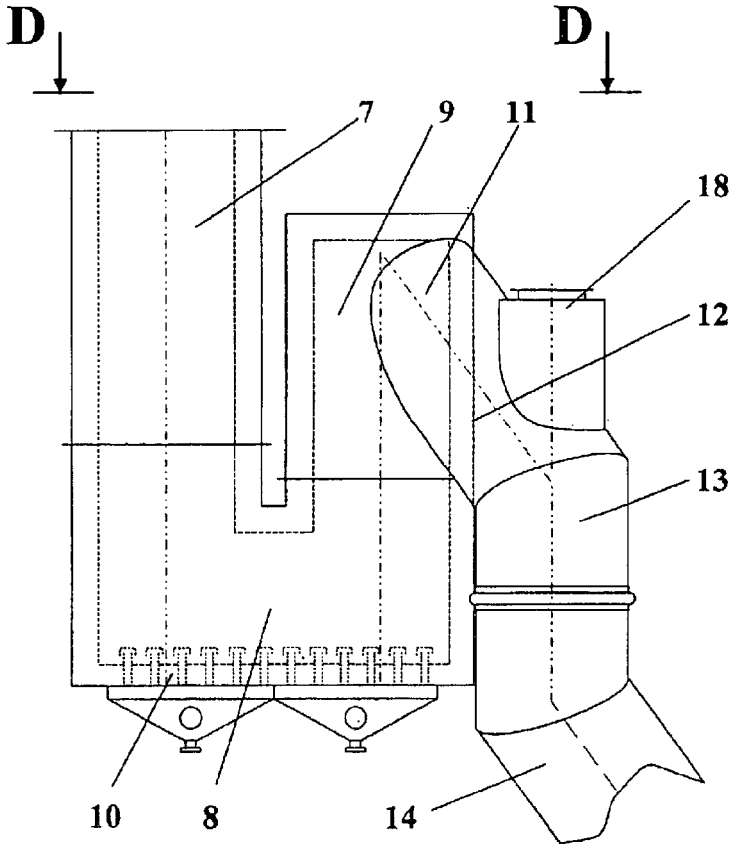
Figure 5:
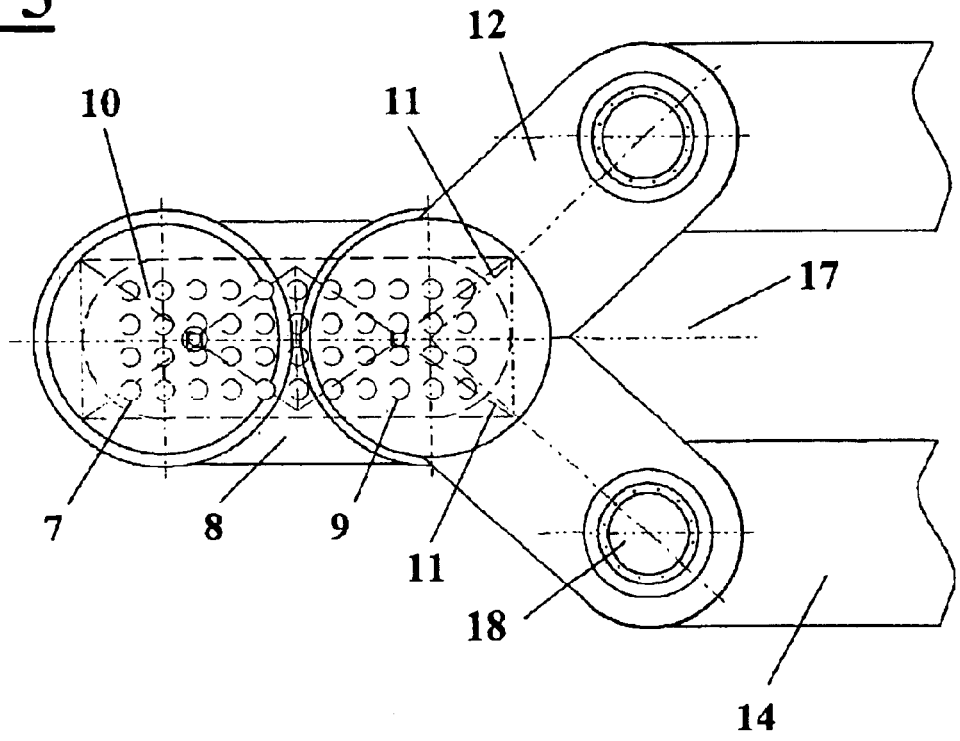

FIG. 2 shows a fluidized bed reactor 1 according to the invention with two cyclone separators 5. Depending on the design of the reactor 1, more specifically, its width, the reactor 1 can also be equipped with one or more than two cyclone separators 5.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Circulating fluidized bed reactor comprising:

a reactor chamber;

at least one duct connected with the reactor chamber for drawing off a flue gas having entrained solid particles from the reactor chamber;

at least one cyclone separator that is connected with the duct for separating solid particles from the flue gas;

at least one recirculation device for recirculating at least a portion of the separated solid particles from the cyclone separator into the reactor chamber, the at least one recirculation device comprising a single siphon-trap gas seal including a single riser having a circumference, an upper end, and first and second outlet openings on the circumference of the riser proximate to the upper end, the first and second outlet openings pointing substantially in the direction of the reactor chamber, a single device for fluidizing the portion of the separated solid particles, and a device for connecting each opening of the gas seal riser with the reactor chamber.

2. Circulating fluidized bed reactor according to claim 1 wherein the first and second outlet openings are each disposed at a height on the gas seal riser, each of the openings being disposed at substantially the same height, the first and second outlet openings defining an angle of 90° to each other.

3. Circulating fluidized bed reactor according to claim 1 wherein the recirculation device has a longitudinal axis and the first and second outlet openings are symmetrical to the recirculation device longitudinal axis.

4. Circulating fluidized bed reactor according to claim 1 wherein the recirculation device has a longitudinal axis and each device for connecting the outlet opening of the gas seal riser with the reactor chamber comprises:

a connecting piece inclined downward from a first end to a second end, the first end being in communication with a one of the outlet openings, the connecting piece extending at an angle of 30 to 90° to the recirculation device longitudinal axis;

a first connecting part extending vertically downward from a first end to a second end, the first end of the first connecting part being connected to the second end of the connecting piece; and a second connecting part inclined downward from a first end to a second end, the first end of the second connecting part being connected to the second end of the first connecting part and the second end of the second connecting part being in communication with the reactor chamber.

5. Circulating fluidized bed reactor according to claim 4 wherein the connecting piece of the device for connecting the first outlet opening of the gas seal riser to the reactor chamber and the connecting piece of the device for connecting the second outlet opening of the gas seal riser to the reactor chamber are disposed symmetrically to each other.

6. Circulating fluidized bed reactor according to claim 4 wherein the reactor chamber has a longitudinal axis and the second connecting part of the device for connecting the first outlet opening of the gas seal riser to the reactor chamber and the second connecting part of the device for connecting the second outlet opening of the gas seal riser to the reactor chamber are disposed substantially parallel to the reactor chamber longitudinal axis or the recirculation device longitudinal axis.

7. Circulating fluidized bed reactor according to claim 1 wherein the reactor chamber has an inlet opening in communication with each device for connecting the outlet openings of the gas seal riser to the reactor chamber, the reactor chamber inlet opening being disposed in a lower region of the reactor chamber.

8. Circulating fluidized bed reactor comprising:

a reactor chamber;

at least one duct connected with the reactor chamber for drawing off a flue gas having entrained solid particles from the reactor chamber;

at least one cyclone separator that is connected with the duct for separating solid particles from the flue gas;

at least one recirculation device for recirculating at least a portion of the separated solid particles from the cyclone separator into the reactor chamber, the at least one recirculation device comprising a siphon-trap gas seal including a riser having a circumference, an upper end, and first and second outlet openings disposed on the circumference of the riser proximate to the upper end at a height on the gas seal riser and pointing substantially in the direction of the reactor chamber, each of the openings being disposed at substantially the same height, the first and second outlet openings defining an angle of 60 to 180° to each other, a device for fluidizing the portion of the separated solid particles, and a device for connecting each opening of the gas seal riser with the reactor chamber.

* * * * *